United States Patent [19]

Gordon

[11] Patent Number: 4,972,979

[45] Date of Patent: Nov. 27, 1990

[54] NEEDLE THREADING DEVICE

[76] Inventor: Edward Gordon, 2309 Pittock St., Pittsburgh, Pa. 15217

[21] Appl. No.: 511,751

[22] Filed: Apr. 20, 1990

[51] Int. Cl.[5] ..... D05B 87/00; D05B 87/04; F21V 33/00

[52] U.S. Cl. ..... 223/99; 362/109; 362/119; 362/120; 362/253

[58] Field of Search ..... 223/99; 112/222, 223, 112/224, 225; 362/109, 119, 120, 253, 157

[56] References Cited

U.S. PATENT DOCUMENTS

| | | | |
|---|---|---|---|
| 242,374 | 5/1881 | Russell | 223/99 |
| 294,171 | 2/1884 | Watts | 112/225 |
| 856,827 | 6/1907 | Welty | 223/99 |
| 1,239,270 | 9/1917 | Hawks | 223/99 |
| 1,241,427 | 9/1917 | Nielsen | 223/99 |
| 1,278,995 | 9/1918 | Petro | 223/99 |
| 1,909,662 | 5/1933 | Conners | 362/109 |
| 2,306,419 | 12/1942 | Worth | 362/109 |
| 2,323,292 | 7/1943 | Bloodgood | 362/109 |
| 2,804,710 | 9/1957 | Stilwell | 223/99 |
| 4,930,871 | 6/1990 | Tannahill | 223/99 |

*Primary Examiner*—Werner H. Schroeder
*Assistant Examiner*—Bibhu Mohanty
*Attorney, Agent, or Firm*—William J. Ruano

[57] ABSTRACT

A needle threading device comprising a flashlight having a needle mounted on the side of the flashlight with the eye of the needle projecting above the lens of the flashlight. A magnifying glass has its handle mounted on the opposite side of the flashlight with the magnifying glass also extending above the lens of the flashlight. The axis of the magnifying glass coincides with the axis of the eye of the needle.

4 Claims, 1 Drawing Sheet

NEEDLE THREADING DEVICE

BACKGROUND OF THE INVENTION

Needle threading has been a problem, particularly for those having poor eyesight, such as many elderly persons. No satisfactory solution has apparently been heretofore made.

SUMMARY OF THE INVENTION

An object of the invention is to overcome the abovementioned problem by providing a novel device which greatly simplifies needle threading, even by those with poor eyesight.

DESCRIPTION OF THE PREFERRED EMBODIMENT

Figure 1:
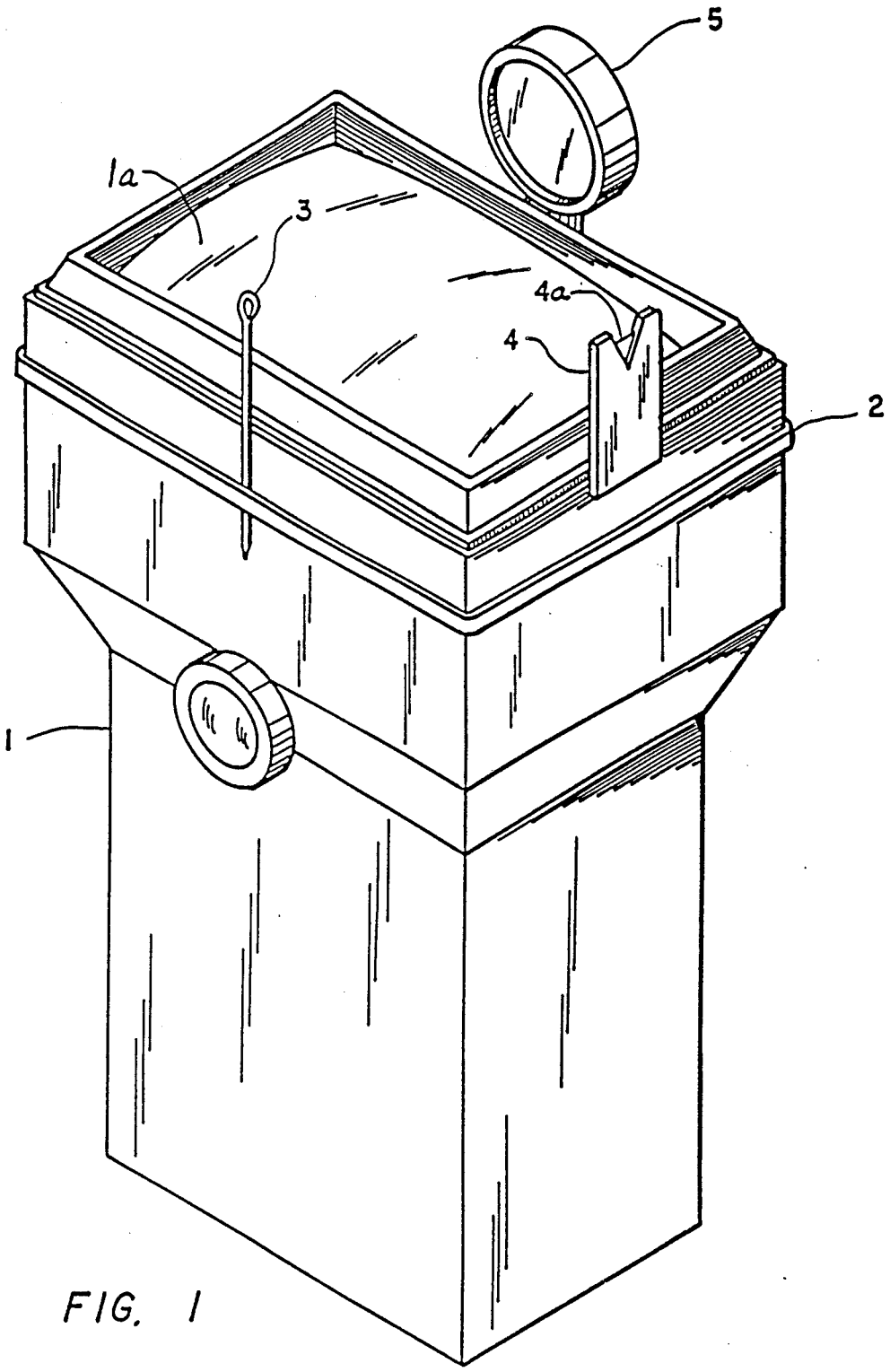
FIG. 1 shows a device embodying the present invention for facilitating needle threading, particularly for those with poor eyesight.

FIG. 1 shows a needle threading device embodying the present invention comprising a flashlight 1 having a lens 1*a* and powered by dry cells contained therein,-all of well known construction.

In accordance with the present invention, I made the wholly unexpected discovery that it is not necessary to illuminate a needle by use of a magnifying glass by projecting the beam of a flashlight directly into the eye of a needle, since this is a tedious, almost impossible and wholly unsatisfactory way of threading a needle.

In accordance with the present invention, and as shown in FIG. 1, a needle 3 may be detachably mounted by being held by a rubber or plastic band 2 so as to have the eye of the needle well above the lens 1*a* and in line with the axis of a magnifying glass 5 having a handle which is also slipped between band 2 and the flashlight. I have unexpectedly found that there is enough diffused light from the flashlight to enable clear viewing of the eye of the needle through the glass 5 when the axis of the lens is at right angles to the axis of glass 5 and that of the needle eye.

The needle and flashlight while shown in opposite the narrower width of the lens may instead be shown as being mounted across the longer width of the lens.

A thread cutter in the form of a cutting blade 4*a* mounted in a support 4 is attached, either permanently as shown, or detachably held by making the support longer so as to be embraced by band 2.

As a modification for a more permanent assembly, an elongated receptical could be mounted for supporting needle 3, and the handle of the magnifying glass could be permanently attached to one side of the flashlight as well as the thread cutter, 4, 4*a*.

During the daytime, a needle can be threaded even without the light from the flashlight.

Thus it will be seen that I have provided a novel assembly for greatly facilitating threading of a needle, particularly by those having poor eyesight and shaky hands, by use of a combination which is either permanently connected or detachably fitted on the outside of a flashlight.

While a flashlight of rectangular formation is shown, my invention is equally applicable to the well known type having a cylindrical handle and circular lens.

While I have illustrated and described a single specific embodiment of my invention, it will be understood that this is by way of illustration only and that various changes and modifications may be contemplated in my invention within the scope of the following claims.

I claim:

1. A device for threading a needle comprising a flashlight having a handle in alignment with a lens, a needle projecting above said lens on one side of said flashlight, a magnifying glass projecting above said lens on the other side of said flashlight, the needle having an eye located on the axis of said magnifying glass, the axis of said magnifying glass being at right angles to the axis of said lens so as to illuminate said needle eye by diffused light emanating from said lens.

2. The device recited in claim 1 including a thread cutter mounted on a side of said flashlight.

3. The device recited in claim 1 wherein said magnifying glass and needle are detachably mounted on opposite sides of said flashlight.

4. The device recited in claim 3 wherein said magnifying glass and needle are detachably mounted by a flexible band surrounding them and said flashlight.

* * * * *